United States Patent [19]

Gottlieb

[11] Patent Number: 4,971,108

[45] Date of Patent: Nov. 20, 1990

[54] INHALATION RESPONSIVE GAS PRESSURE REGULATOR

[76] Inventor: Mark Gottlieb, 941-B 25th St., NW., Washington, D.C. 20037

[21] Appl. No.: 85,214

[22] Filed: Aug. 13, 1987

Related U.S. Application Data

[63] Continuation of Ser. No. 908,918, Sep. 19, 1986, abandoned, which is a continuation-in-part of Ser. No. 826,992, Feb. 7, 1986, abandoned.

[51] Int. Cl.[5] ..... B63C 11/22

[52] U.S. Cl. ..... 137/495; 128/204.26; 137/908

[58] Field of Search ..... 137/494, 495, 907, 908, 137/505.47; 92/90, 91, 92, 93; 128/204.26; 251/61, 61.4

[56] References Cited

U.S. PATENT DOCUMENTS

| | | | |
|---|---|---|---|
| 85,566 | 1/1869 | Corliss | 137/505.41 |
| 1,504,411 | 8/1924 | Anderson | 137/494 |
| 2,572,658 | 10/1951 | Perkins . | |
| 2,590,215 | 3/1952 | Sausa . | |
| 2,693,820 | 11/1954 | Jones . | |
| 2,823,670 | 2/1958 | Page . | |
| 2,856,945 | 10/1958 | Trevaskis | 137/494 |
| 2,865,369 | 12/1958 | Kline . | |
| 3,048,121 | 8/1962 | Sheesley | 92/90 X |
| 3,062,207 | 11/1962 | Novelli . | |
| 3,138,154 | 6/1964 | Hedberg . | |
| 3,149,631 | 9/1964 | Svenson . | |
| 3,224,444 | 12/1965 | Dempster . | |
| 3,393,701 | 7/1968 | Brown | 137/505.47 X |
| 3,758,069 | 9/1973 | Whitten | 251/58 |
| 3,795,257 | 3/1974 | Fabish . | |
| 4,094,314 | 6/1978 | Le Cornec . | |
| 4,192,298 | 3/1980 | Ferraro et al. | 137/494 X |
| 4,219,017 | 8/1980 | Shamlian . | |
| 4,266,538 | 5/1981 | Ruchti . | |
| 4,331,140 | 5/1982 | Hallsey . | |
| 4,386,624 | 6/1983 | Christianson . | |
| 4,436,090 | 3/1984 | Darling . | |
| 4,494,537 | 1/1985 | Gottlieb . | |
| 4,503,852 | 3/1985 | Christianson . | |

FOREIGN PATENT DOCUMENTS

| | | | |
|---|---|---|---|
| 379129 | 8/1931 | United Kingdom | 128/204.26 |
| 1339898 | 12/1973 | United Kingdom | 128/204.26 |

OTHER PUBLICATIONS

Skin Diver, Nov. 1983, "Oceanic/U.S.A. Omega" Article.

*Primary Examiner*—Stephen M. Hepperle
*Attorney, Agent, or Firm*—Oblon, Spivak, McClelland, Maier & Neustadt

[57] ABSTRACT

A breathing apparatus forms a second stage of an inhalation responsive gas pressure regulator. The inhalation diaphragm is in the form of a cylinder within which an arcuate assembly is positioned, the arcuate assembly opening a valve for permitting the introduction of air from a second stage into the casing during inhalation.

23 Claims, 6 Drawing Sheets

INHALATION RESPONSIVE GAS PRESSURE REGULATOR

This application is a continuation of application Ser. No. 908,918, filed on Sept. 19, 1986, now abandoned, which his a continuation-in-part of application Ser. No. 826,992, filed on Feb. 7, 1986, now abandoned.

BACKGROUND OF THE INVENTION

1. Field of the Invention:

The present invention relates to an apparatus for supplying air or other fluid to a user on demand. More particularly, the present invention relates to such an apparatus for use in an underwater breathing system, such as a scuba system.

2. Description of Related Art:

Scuba diving is a sport enjoyed around the world. Diving as a sport has been around for several decades, but it has only been recently that the dive industry has attempted to make diving gear that is comfortable, attractive, compact and light weight.

Conventional scuba regulators consist essentially of two parts. A first stage fits on the tank which is attached to the user's back. The tank contains air or other gas pressurized to between 2,000 and 4,000 psi when full. The first stage lowers the air intermediate pressure of the air leaving the tank to a constant pressure of about 130 psi above the ambient pressure out of the "low pressure" port, regardless of the remaining tank pressure.

The air from the first stage flows to the second stage through a flexible tube. The second stage includes a valve structure which supplies the pressurized air to the user on demand. Typically, this is accomplished by a diaphragm which moves in response to the inhalation of the user causing a valve to let air escape for the user. Upon the user exhaling, the diaphragm returns to its original position and the exhaled gas is removed from the regulator through an appropriate exhaust valve.

However, conventional regulators have several shortcomings. They are quite bulky due to the large inhalation diaphragm which operates the second stage valve. This large size is not only unattractive but increases the manufacturing costs and results in the regulators being unnecessarily heavy.

The conventional regulator diaphragm is in the form of a circular disk. The diaphragm applies a force to the second stage valve proportional to the pressure differential on either side of the diaphragm (caused by inhaling) times the effective surface area of the diaphragm. In particular, the effective surface area equals $\pi D^2/4$, where D is the diameter of the circular diaphragm. If the diaphragm has a diameter of 2.5 inches, the surface area will be 4.9 square inches.

Recently a new type of regulator has appeared which overcomes some of the problems of the conventional regulator. These regulators, known as "servo assisted" regulators use a smaller inhalation diaphragm but with a pneumatic amplifier system in the second stage to amplify the diver's breathing signal. In such systems are shown in U.S. Pat. No. 4,219,017 and in Applicant's U.S. Pat. No. 4,494,537. In such devices an inhalation diaphragm mounted on the casing is movable in response to user's demand but does not directly control the air supply valve. Instead, the inhalation diaphragm controls a sensitive pilot valve through a control lever which in turn controls the air flow. However, designs requiring pilot valves have certain shortcomings, amongst them are a relatively complex structure involving numerous parts, high manufacturing costs and a less rugged regulator.

SUMMARY OF THE INVENTION

It is an object of the present invention to provide an inhalation responsive gas pressure regulator having good sensitivity with reduced size and weight.

It is a further object of the present invention to provide a second stage scuba regulator having good sensitivity with reduced size and weight.

It is a further object of the present invention to provide an inhalation responsive gas pressure regulator having fewer parts and reduced complexity.

It is a further object of the present invention to provide an inhalation responsive gas pressure regulator having a cylindrical inhalation diaphragm.

Although the remainder of the specification may refer to a diving regulator, it is to be understood that the invention is equally applicable to any inhalation responsive gas pressure regulator.

According to the present invention, a substantially cylindrical hollow casing has an inlet opening at one end, the inlet opening being connectable to a hose for supplying pressurized air from a first stage of the regulator at the intermediate pressure of approximately 130 psi. An elastic and substantially cylindrical diaphragm is positioned in the casing and extends substantially coaxial with the axis of the casing. One end of the diaphragm is sealed to an inner surface of the casing to form a fluid tight seal and another end is maintained adjacent another open end of the casing. An outlet opening to which a mouthpiece is attached communicates with the interior of the casing at a point positioned between the sealed end of the diaphragm and the pressurized air inlet. The pressurized air inlet is normally closed by a spring loaded inlet valve in order to prevent the pressurized air from the first stage from entering the casing and the mouthpiece. An assembly is provided for opening the inlet valve upon the distortion of the inhalation diaphragm resulting from an inhalation by the user of the regulator. In one embodiment, the assembly consists of a post extending within the diaphragm and coaxial with the casing and having one end terminating at one end of the casing having the valve, and another end terminating adjacent to, but not necessarily attached to, the unsealed end of the casing. A ring surrounds the post on the valve side of the post and contacts the valve in such a manner as to open the valve when the ring presses the valve in the direction of the valve end of the casing. Attached to the ring are an angularly spaced plurality of convex arcuate bands whose other ends are fixed to the opposite end of the post. Mid-portions of the bands are positioned adjacent to the inner surface of the diaphragm.

Upon a user inhaling, the pressure within the diaphragm drops so that the cylindrical diaphragm distorts inwardly. This presses inwardly on the mid-portions of the bands and so tends to straighten them out, with the result that the ring is pressed toward the valve end of the casing. This in turn opens the valve and permits pressurized air from the first stage to enter the casing and the mouthpiece.

In another embodiment, the assembly for opening the inlet valve includes a plurality of substantially T-shaped pivot levers arranged within the diaphragm such that the levers pivot in response to the distortion of the diaphragm to operate the valve. In particular, the pivot levers are arranged to form a cylindrical array within the diaphragm with first sides of the levers positioned adjacent to the interior surface of the diaphragm, and extending parallel to the axis of the diaphragm. Second sides of the levers extend in a plane toward the axis of the diaphragm. A disc shaped member is fixed relative to the casing and has a periphery extending to the bend between the sides of the levers so that the levers pivot about the periphery, using the periphery of the disc shaped member as a fulcrum.

A rod extends coaxially with the diaphragm and has a valve member of the inlet valve at one end and another end that extends through the disc shaped member and the plane defined by the radially extending sides of the pivot levers. The rod is biased by a spring to a position where the valve member closes the inlet valve and the tips of the second sides of the pivot levers are pressed between the disc shaped member and an enlargement at the end of the rod. As a result, the pivoting of the pivot levers in response to distortion of the diaphragm moves the rod axially, and so opens the inlet valve.

Other arrangements may be provided for opening the inlet valve in response to distortion of the diaphragm.

The above structure provides a particularly compact regulator using a diaphragm which gives a large opening force with a compact design. As noted above, a flat disk diaphragm of 2.5 inch diameter will provide a 4.9 square inch effective area. In contrast, the area of a cylinder is equal to $\pi LD$ (where L is the length of the cylinder and D is the diameter of the cylinder), so that a cylindrical diaphragm having a length of 2.5 inches and a diameter of only 0.9 inches will provide an effective surface area of 7.1 square inches, providing a 45% increase in surface area and consequently the force acting on the valve. It is therefore possible to provide a cylindrical regulator having a diameter of less than 1.25 inches, as compared to the conventional regulator which must include a diaphragm casing having the diameter greater than 2.75 inches.

The end of the diaphragm opposite the air inlet is closed by a check valve in the form of an elastic disk. In the first embodiment a purge button can be used to push the post and bands toward the valve end of the casing and open the inlet valve for purging the regulator. In the second embodiment, the purge button is mounted on a diaphragm and aids the cylindrical diaphragm in pivoting the pivot levers during inhalation. An additional exhaust valve can also be provided.

In a preferred form of construction of the first embodiment, the post and bands are unitarily formed from a single flat piece of molded or die cut plastic. The ring is then positioned on the post and the free ends of the bands are fixed to the ring.

The diaphragm may be pleated or otherwise not perfectly cylindrical when seen in section.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
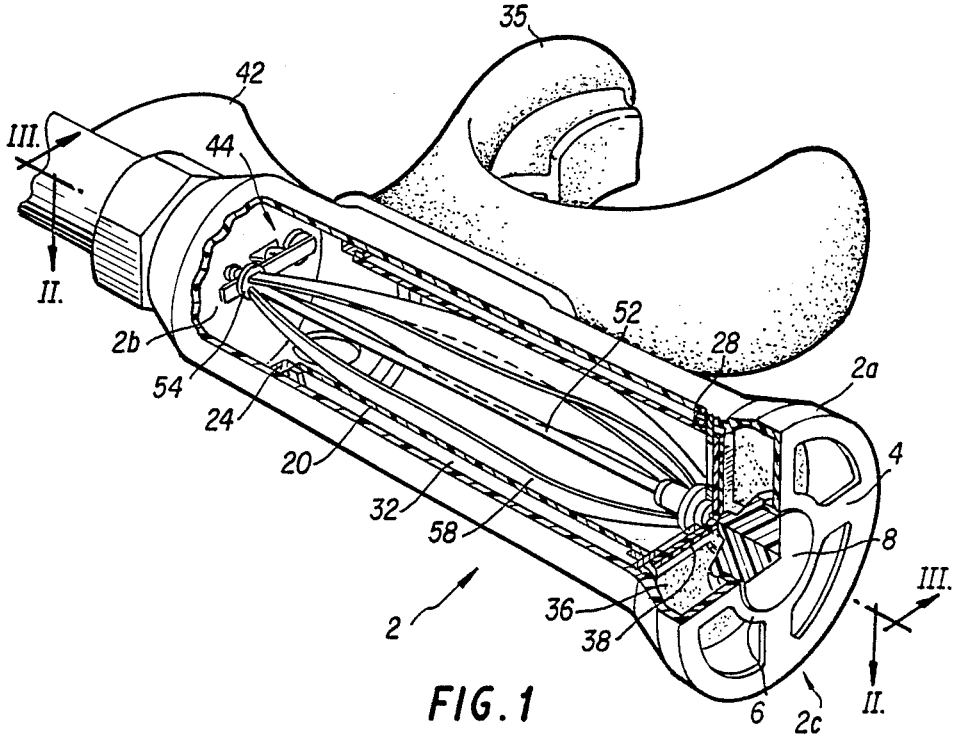
FIG. 1 is an orthogonal view, partially in section, of an embodiment of the regulator of the invention.

Embodiments will now be described with reference to the attached figures wherein like reference numerals are used to designate the same or similar parts throughout the several views.

Figure 4:
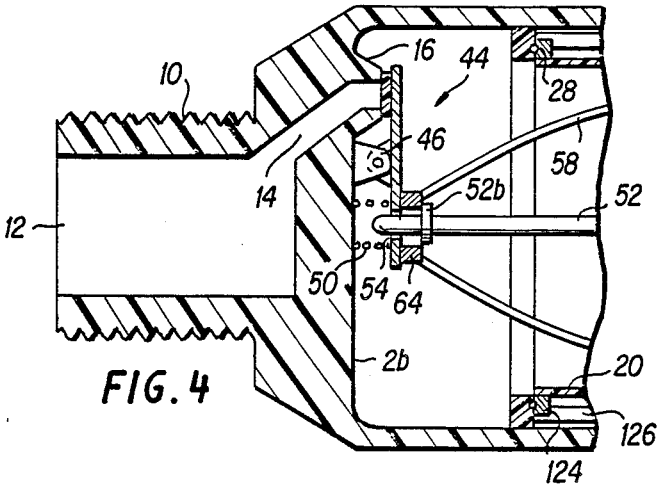
FIG. 4 is a view in section of a portion of the embodiment of FIG. 1.

The breathing apparatus of the present invention constitutes the second stage of a diving regulator and has a casing 2 having a cylindrical shape. The word "cylindrical" here is used in its broadest sense and includes shapes which are not of a constant diameter. For example, it includes shapes which are tapered along their length, or which are flared at one end as shown at *2a* in FIG. 1. The casing is preferably injection molded from a rigid plastic as two semi-cylinders which are fused together. The casing has a closed end *2b* and a separable open end *2c*. The open end *2c* is attached to the remainder of the casing by being screwed on at threads *2d*. The open end is further provided with radial ribs *2e* (FIG. 5) and with a ring 6 for supporting a purge button 8 whose function will be described later. Extending from the closed end *2b* of the casing is a flange 10 having external threads (FIG. 4). A bore 12 of the flange 10 terminates in a passage 14 having an opening at a raised annular valve seat 16 on the closed end *2b* of the casing.

A diaphragm 20 is in the form of a cylinder and is positioned within the casing while extending coaxial therewith. The diaphragm 20 is formed of an elastic material such as natural rubber or an elastomer having properties similar thereto. An annular projection 24 extends from the inner surface of the casing. The projection 24 may, for example, be formed unitarily with the casing.

Figure 6:
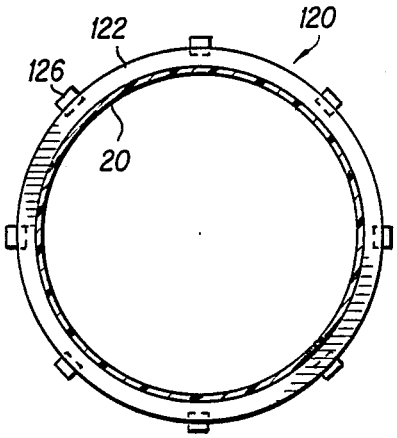
FIG. 6 is an end view of the cage assembly.

A diaphragm cage 120 (FIG. 6) is formed of rings 122 and 124 connected by struts 126 to form a rigid cage. The diaphragm 20 is bonded to the rings 122 and 124 in a fluid tight manner, for example by using an adhesive. The cage 120 is then slid into the casing 2 prior to screwing on the end *2c*, until the ring 124 abuts the projection 24 with a fluid tight seal, via the O-ring 128.

The cage 120 is then fixed within the casing 2 by screwing on the end *2c*. At this time, the ribs *2e* of the end 2c engage the outer ring 38a of a spyder (discussed below) and press the outer ring 38a into a fluid tight seal with the ring 122 of the cage 120, via the O-ring 129.

The ribs 2e should be sufficiently spaced to permit air or water to pass the recesses 2f therebetween, and enter the space 32 between the diaphragm 20 in the casing, whereby the space 32 is at the ambient pressure of the water within which the regulator is being used. As a result, the cage 120 is fixed within the casing, yet permits the diaphragm 20 to communicate with the ambient pressure.

Figure 3:
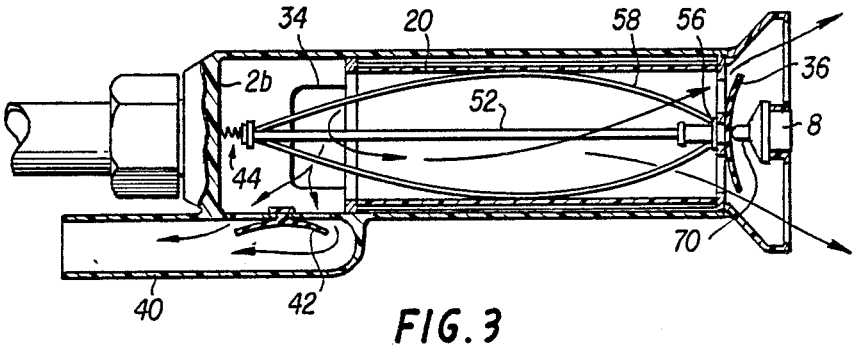
FIG. 3 is a sectional view of the regulator of FIG. 1, as seen along line III—III.

An opening 34 in the casing includes a flange on the exterior of the casing (not shown) for attachment of a mouthpiece 35 so that a diver using the regulator can breath air from the interior of the casing. This opening 34 terminates at the ring 24, as seen in FIG. 3.

Figure 7:
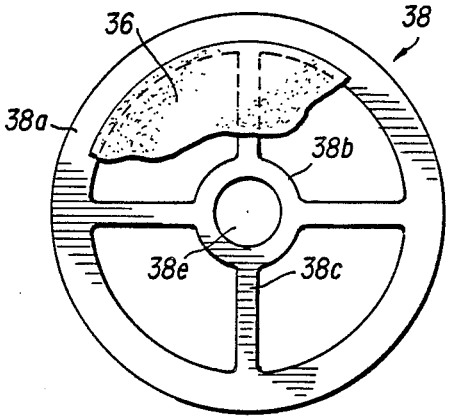
FIG. 7 is a detail of the spyder.

The spyder 38 (FIG. 7) is formed of a stiff resilient material, such as rigid plastic or sheet metal. The spyder has an outer ring 38a which forms a seal with ring 122. The outer ring is connected to a hub ring 38b by spokes 38c. A central aperture 38e is provided in the ring, for a purpose to be described below.

An exhaust valve 36 completely covers that portion of the spyder which is radially inside of the ribs 2e, and so can form a fluid tight seal for the end of the diaphragm cage. The exhaust valve 36 is formed of a flat disc of rubber or similar elastomeric material. A central portion of the disc has a projection 36a at one side, and the other side is held pressed against the spyder 38 by a projection 70 of the purge button 8.

Figure 5:
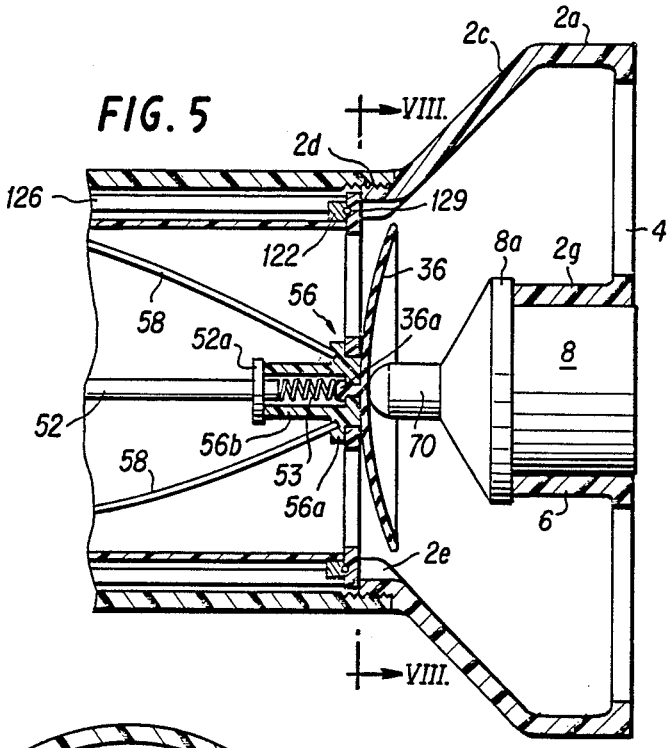
FIG. 5 is a sectional detail of an end of the casing.
Figure 8:
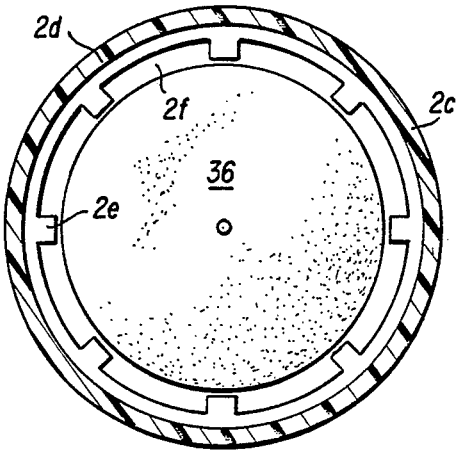
FIG. 8 is a section taken along line VIII of FIG. 5.

The purge button itself includes a rim 8a supported on the flange 2g of ring 6, so that it can only move toward the end 2b of the casing (to the left in FIG. 5).

The exhaust of exhaled air is also provided by the exhaust tube 40 opening into the casing. A check valve 42 of a conventional design can be used for preventing water from entering the casing via the tube 40.

An inlet valve 44 normally seals on the seat 16 and maintains the passage 14 in a closed state. The valve 44 is formed of a lever of rigid material, such as hard plastic or metal, which is pivoted to a projection 46 forming a part of the end 2b of the casing. A valve sealing member 48 formed of an elastomeric material is positioned on the end of the lever so that it maintains the passage 14 sealed when the lever is biased into a closed position by the spring 50.

A hub 56 is formed of a disc-like base 56a having a smaller diameter end which fits into aperture 38e of the spyder, and permits the seating of the hub 56. A hollow cylindrical sleeve portion 56b extends from the base and has a cylindrical bore into which the end of a post 52 may be inserted, up to the limit provided by annular stop 52a. A spring 53 within the bore of the sleeve portion 56b tends to bias the post 52 out of the bore, for maintaining tension on the valve 44, as described below. The other end of the post 52 is slidably inserted into an opening 54 of the valve lever. Another annular stop 52b is provided at this other end of the post for use during purging, as described below. If necessary, the end 2b of the casing may be provided with a bore to accommodate the end of the post 52, either in a movable or a fixed position.

Figure 2:
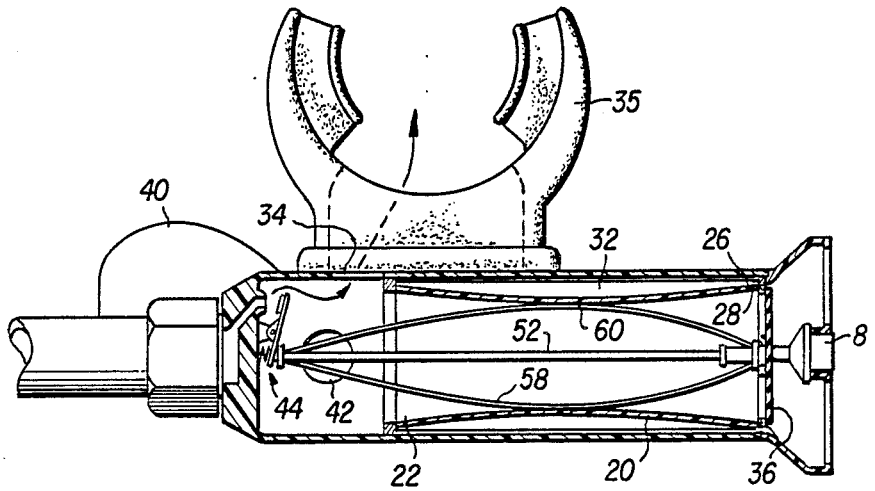
FIG. 2 is a sectional view of the regulator of FIG. 1, as seen along line II—II.
Figure 10:
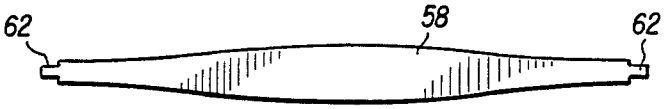
FIG. 10 is a detail showing one of the bands.

A plurality of bands 58 extend between the base 56a of the hub and a ring 64 mounted on the post 52. Each of the bands is formed of a resilient material and has nipples 62 at either end for fitting into corresponding holes of the hub 56 or the ring 64, so that the bands can be fixed thereto. Each of the bands is maintained in an arcuate shape with a convex surface thereof having a mid-portion engaging or adjacent to the inner surface of the diaphragm, as shown in FIG. 2. The bands are preferably evenly annularly or circumferentially spaced about the post 52 and have increased widths toward the center thereof, as shown in FIG. 10. The number and widths of the bands should be sufficient to cover a maximum circumferential area of a mid-portion of the diaphragm without interfering with one another. For example, the mid-portions of the bands should almost touch when pressed inward by the diaphragm.

The ring 64, the bands 58, the hub 56 and the post 52 together form a unitary band assembly which is thus loosely mounted within the diaphragm 20. The band assembly is resiliently restrained from movement in the radial direction by the resilience of the diaphragm 20. The band assembly is resiliently restrained against movement in the axial direction toward the casing end 2b by the resilient force of the spring 50. The band assembly is resiliently restrained against movement in the axial direction away from the casing end 2b by the spyder 38. Moreover, the ring 64 is maintained tensioned against the valve 44 by the spring 53, via the post 52 and stops 52a and 52b.

However, upon inhalation by a user, the pressure within the casing 2 drops below that within the space 32 which is exposed to the ambient pressure. This causes the diaphragm to contract in a radial inward direction, as best seen in FIG. 2. As the diaphragm squeezes against the bands, it tends to straighten the bands, thus forcing the ring 64 toward the casing end 2b. This in turn causes the valve lever to open, thereby permitting pressurized air from the first stage to pass into the interior of the casing and into the mouthpiece 35.

When inhalation is terminated, the pressure differential across the diaphragm is eliminated and it returns to its undistorted position, thereby permitting the spring 50 to cause the bands to radially expand and the valve 44 to close.

Upon exhaling, the exhaled air creates a positive pressure within the casing, thereby distorting the exhaust valve disk 36 (FIG. 3) so that exhaled air can be exhausted past the seal between this disk and the spyder ring, and also through the exhaust tube 40.

Manual pressure upon the purge button overcomes the resilient force of the spring 50 and causes the entire band assembly and the disc 36 to move toward the surface 2b, thereby opening the valve lever and permitting the purging of the casing. At this time the stops 52a and 52b respectively engage the sleeve 56b and the ring 64.

At least a portion of the post 52 and/or ring 64 may be Teflon covered.

The diaphragm may include circumferential corrugations at one or both of its ends to prevent axial stretching of the diaphragm material when the diaphragm distorts inward. Longitudinal corrugations may also or instead be provided for the same purpose.

The length of the bands 58 may be divided into three parts by providing hinge joints connecting a midportion of each band with ends thereof.

Figure 9:
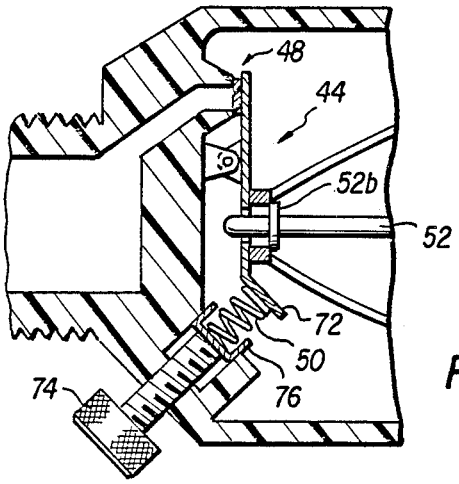
FIG. 9 is a detail illustrating an embodiment having an ajustment screw.

FIG. 9 shows an alternate embodiment for the valve lever in which the end 72 of the valve lever is angled and an adjustment screw 74 extends through the casing. The adjustment screw terminates in a support cup 76 which supports one end of the spring 50 for adjusting the spring force of this spring. This has the effect of adjusting the amount of inhalation force necessary to open the valve.

A further embodiment of the regulator is illustrated in FIGS. 11–17.

As in the first embodiment, the breathing apparatus constitutes the second stage of a diving regulator and has a substantially cylindrical casing 202 including a closed end 202*a* and an opposite flared open end 202*c* having an exhaust valve assembly 202*b* screwed thereon. The open end and exhaust valve assembly are described in greater detail below.

The closed end 202*a* of the casing is provided with a threaded flange 210 for connection to a source of pressurized air. A valve seat member 214 is threaded in the bore 212 of the flange and has a tapered valve seat part 216. The casing also includes a flanged opening 234 for attachment of a mouth piece (not shown), as in the first embodiment.

The diaphragm 220 is mounted substantially flush against the interior surface of the casing and includes annular enlargements 220*a* and 220*b* at its ends, which enlargements are press fit into corresponding annular grooves of the casing. Openings 222 in the casing permit water pressure to communicate with the exterior of the diaphragm.

A rigid tube 224 is unitarily formed with the casing and extends therein along the axis of the casing. One end of the tube projects from the closed end 202*a* of the casing and surrounds the valve seat member 214. The other end of the tube 224 terminates in a disc shaped member 226 having a central aperture 228. The disc shaped member may be a separate member threaded onto the tube 224. A plurality of apertures 230 near the base of the tube 224 permit fluid communication between the interior and exterior of the tube 224.

Figure 11:
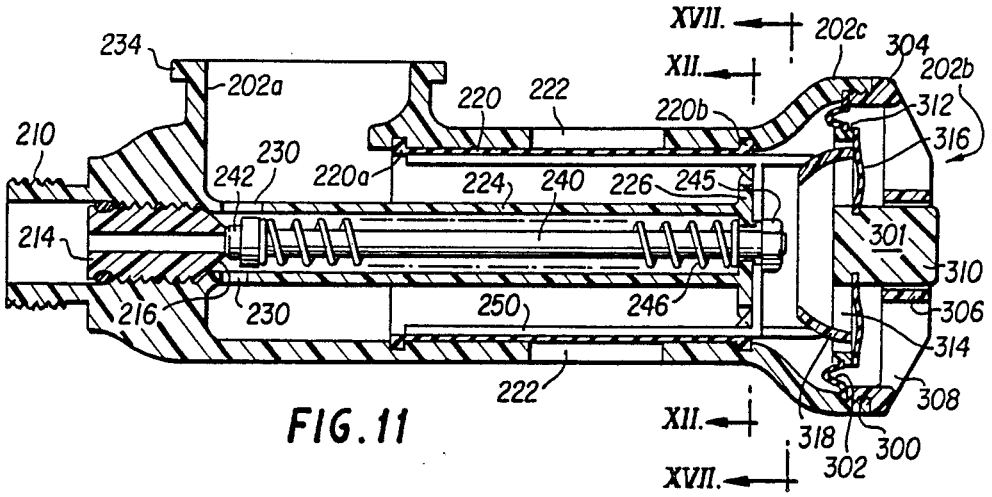
FIG. 11 is a sectional view of a second embodiment of the regulator.
Figure 15:
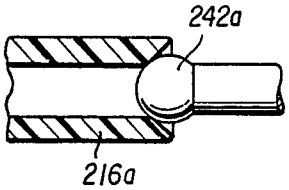
FIGS. 15 and 16 are details showing different embodiments of the valve member and valve seat.
Figure 16:
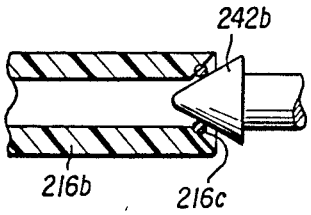
Figure 17:
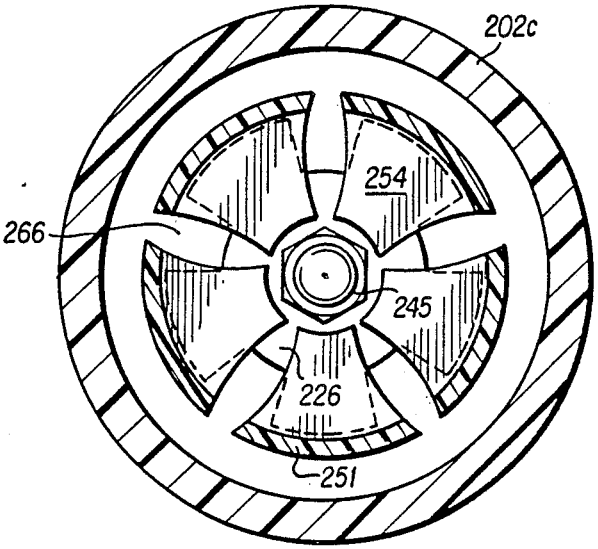
FIG. 17 is a sectional view taken along line XVII—XVII in FIG. 11.

A rod 240 extends within the tube 224, coaxially with the casing. One end of the rod terminates in an enlarged valve member 242, which may be formed of a elastomeric material in order to ensure a good seal against the valve seat part 216 in order to close the inlet valve 244. In the embodiment of FIG. 11, the valve member has a flat surface bearing against the sharp annular edge of the valve seat part 216. However, other embodiments are possible, such as those shown in FIGS. 15 and 16. In FIG. 15, the valve seat part 216*a* has a reverse taper as compared to the valve seat part 216, and the valve member 242*a* is rounded. In FIG. 16, the valve seat part 216*b* is again reverse tapered and is provided with an O-ring 216*c* which forms a seat against a cone shaped valve member 242*b*.

The rod 240 has another end extending through the aperture 228 and out of the tube 224. This other end is threaded and has a nut 245 screwed thereon. A coil spring 246 is wound around the rod 240. One end of the coil spring presses against the disc shaped member 226, whereas the other end of the spring presses against an enlarged portion of the valve member 242, so that the spring resiliently maintains the valve member pressed against the valve seat part 216.

An annular array of rigid T-shaped pivot levers 250 (only two are shown in FIG. 11) are positioned in the diaphragm. Each of these pivot levers (FIG. 13) has a first end 252 and a concavely tapered second end 254 which is angled relative to the end 252 by a right angle at a bend 256. A reinforcement 258 may also be provided at the bend in order to maintain the rigidity of each lever. The first ends 252 normally are positioned to extend parallel to the axis of the diaphragm and are aligned in an annular array and held closely adjacent the inner surface of the diaphragm. The first ends 252 may also be longitudinally tapered to have a reduced width in a direction away from the bend 256, for a reason to be discussed below. Each pivot lever has a leg 251 including a bevelled edge 253, for a purpose described below.

The second ends 254 are normally positioned to extend radially in a transverse plane toward the axis of the diaphragm. The second ends 254 are tapered toward their distal tips 255 with a concave taper, and extend to a point adjacent the rod 240 and between the disc shaped member 226 and the nut 245. The nut 245 may be tightened until the second ends 254 of the pivot levers are resiliently pressed flat against the disc shaped member 226, but is not tightened sufficiently for the valve element 242 to lift off the valve seat part 216.

Figure 12:
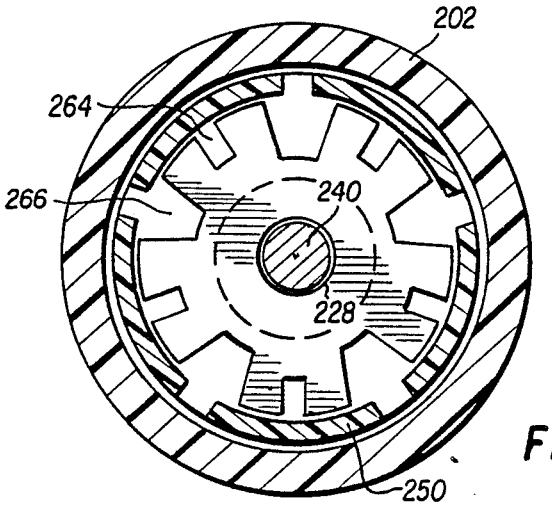
FIG. 12 is a sectional view taken along line XII—XII in FIG. 11.
Figure 13:
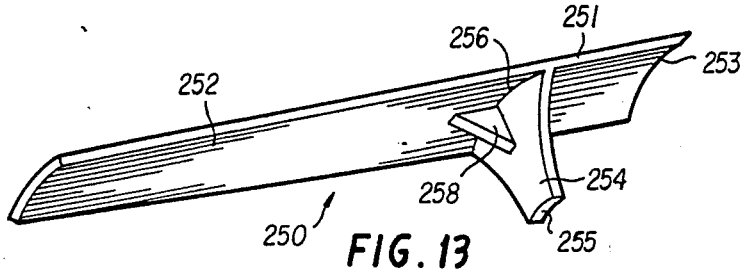
FIG. 13 is a detail showing one of the pivot levers.

As best seen in FIG. 12, the bottom surface of the disc shaped member 226 against which the second ends 254 of the lever 250 are retained have through recesses 264 to accommodate the reinforcements 258. Recesses 266 are also provided extending through the disc shaped member at circumferential positions between the second ends 264 of the pivot levers, in order to permit air to exhaust while flowing past the disc shaped member.

Figure 14:
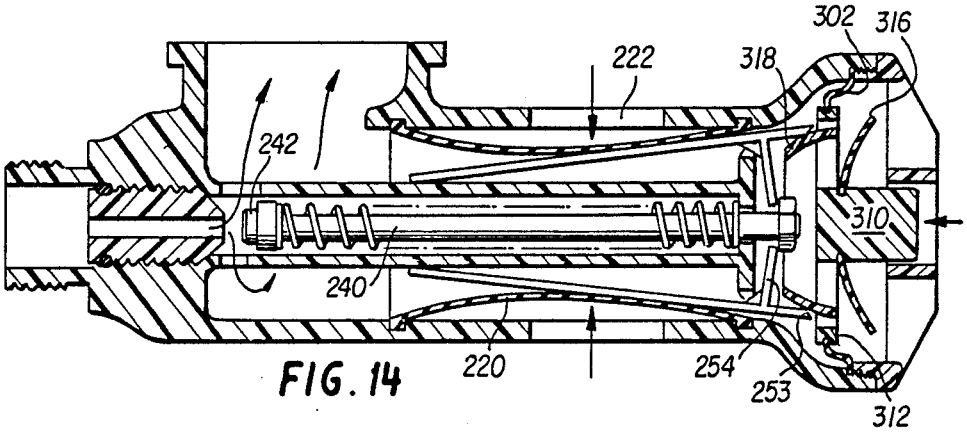
FIG. 14 is a view corresponding to FIG. 11, but showing the positions of the elements during inhalation.

As best seen in FIG. 14, upon inhalation, the diaphragm 220 distorts inwardly and so causes pivoting of the pivot levers about the outer periphery of the disc shaped member 228 as a fulcrum (the taper of the first ends 252 prevents mutual interference of these ends at this time). The distal tips 255 of the second ends 254 are thus caused to move in a direction having a substantial axial component (to the right as seen in FIGS. 11 and 14), as a result of which the rod 240 and attached valve member 242 are moved to the right. This movement of the valve member 242 opens the inlet valve 244 and so permits compressed air to flow through the bore of valve seat member 214, the apertures 230 and the opening 234 for inhalation. Upon the termination of inhalation, the diaphragm 220 and levers 250 return to their rest position of FIG. 11 which permits and the spring 240 to press the valve member 242 against the valve seat part 216 to close the inlet valve 244.

The exhaust valve assembly 202*b* includes a purge button assembly 301 and is threaded onto the flared open end of the casing 202 by the screw threads 300. An annular purge button support diaphragm 302 has an outer end clamped between the casing 202 and the exhaust valve assembly 202*b* by the threading of the exhaust valve assembly onto the casing at 300. The exhaust valve assembly 202*b* further includes an exhaust spider having an outer ring 304 and an inner ring 306 connected by radial struts 308.

The purge button assembly 301 includes a purge button 310 extending through the inner ring 306. The purge button is unitarily formed with a ring 312 via a plurality of radial struts 314 fixed thereto. The ring 312 supports the radially inner end of the purge button support diaphragm 302 in a fluid tight manner.

An exhaust valve 316 is in the form of an annular elastomeric member having an inner periphery fitted in an annular groove of the purge button 310. The exhaust valve normally lays flat between the purge button and the ring 312 and seals the annular passages defined between the purge button 310, the ring 312 and the struts 314. However, during exhaust, the positive pressure within the casing 202 causes air to pass through the recesses 266 of the disc shaped member 226 and between the struts 314, thereby lifting the exhaust valve and escaping from the regulator.

A continuous annular purge ring 318 is connected to the struts 314 and extends toward the legs 251 of the pivot levers 250. The outer surface of the ring closest to the legs 251 of the pivot lever 250 is tapered radially inwardly and is positioned closely adjacent the bevelled edges 253, with the slight gap therebetween. However, upon manually pressing the purge button 310 inwardly, the purge button assembly including the purge button 310, the struts 314 and the rings 312 and 318, all of which are unitarily formed, move toward the pivot levers 250 (to the left in FIG. 11). Due to the resulting pressing contact of the tapered ring 318 with the bevelled edges 253 of the pivot levers, the pivot levers pivot in a counterclockwise direction, resulting in the opening of the valve 244 to purge water from the regulator.

It should be noted that since the purge button assembly 301 is mounted to the casing 202 via the diaphragm 302, and is fluid tight during inhalation due to the exhaust valve 316 sealing the annular space between the purge button 310 and the ring 312, during such inhalation the entire purge button assembly and diaphragm 302 will move to the left (as seen in FIG. 14) and press upon the pivot levers 250 with a force proportional to the surface area of the purge button support diaphragm and the purge button assembly times the pressure differential across the purge button supply assembly. As a result, the purge button support assembly will assist the cylindrical diaphragm 220 in pivoting the pivot levers 250 to open the valve 244 in the manner shown in FIG. 14. This assist provided by reduction in the size of the cylindrical diaphragm 220, and so a further reduction in the diameter of the regulator.

An additional exhaust assembly, similar to assembly 40-42 of the first embodiment may also be provided.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An inhalation responsive breathing regulator for supplying air to a user on demand for underwater use, said apparatus comprising:

a first stage comprising means for supplying air at a constant pressure; and a second stage in fluid communication with said first stage and comprising a hollow casing; normally closed inlet means operable for selectively and intermittently communicating a portion of the interior of said casing with said first state, whereby air under pressure from said first stage can intermittently enter said portion of the interior of said casing; outlet means associated with said casing and having means for communicating the portion of the interior of said casing with a user inhalation system; spring means for maintaining said inlet means in a normally closed state; and means responsive to an inhalation of the user for opening said normally closed inlet means so that said air under pressure from said first stage may enter said portion of said interior of said casing, wherein said means for opening comprise:

(a) a substantially cylindrical diaphragm in said casing, said diaphragm being inwardly distortable in response to a pressure differential between said air in said portion of said casing interior and an ambient fluid;

(b) means for communicating said pressure differential to said diaphragm, wherein said diaphragm may distort, and (c) means responsive to a distortion of substantially the entire cylindrical surface of said diaphragm for opening said inlet means.

2. The apparatus of claim 1 wherein said casing is substantially cylindrical and is substantially coaxial with said diaphragm.

3. The apparatus of claim 2 wherein said diaphragm has an axial edge fixed relative to an interior surface of said casing.

4. The apparatus of claim 3, including a cage, wherein said diaphragm is mounted on said cage, said cage being fixed relative to said interior surface of said casing with a fluid tight seal.

5. The apparatus of claim 4 wherein said outlet means is positioned between said inlet means and said cage.

6. The apparatus of claim 2 wherein said inlet means comprise means connectable to said first stage and having an opening in said portion of said interior, and inlet valve means operable for selectively sealing said opening.

7. The apparatus of claim 6 wherein said means for operating said inlet means comprise a plurality of arcuate resilient bands positioned in said diaphragm, convex surfaces of each of said bands being engageable with an inner surface of a mid-portion of said diaphragm, whereby said distortion of said diaphragm tends to straighten said bands for operating said valve means upon straightening of said bands.

8. The apparatus of claim 7 wherein said inlet valve means is operable in response to pressure thereon in the direction of the axis of said diaphragm by said means for operating, and wherein said means for operating further comprise:

a hub mounted adjacent another end of said diaphragm;

a post extending in said diaphragm and substantially coaxial therewith, said post having one end fixed to said hub;

a ring slidably mounted on said post and engaging said inlet valve means;

said bands being angularly spaced about said post, first ends of said bands being fixed to said slidably mounted ring, second ends of said bands being fixed to said hub.

9. The apparatus of claim 8 wherein said inlet valve means comprise:

an elongated rigid lever pivoted to an axis fixed relative to said casing adjacent said opening of said conduit means;

a valve seal element fixed to said lever; and means for biasing said lever to a position wherein said valve seal element closes said opening, wherein said ring engages said lever on an end of said lever opposite said valve seal element for opposing said means for biasing.

10. The apparatus of claim 1 including fluid exhaust means in said casing, said exhaust means including check valve means for preventing the introduction of said ambient fluid into said casing.

11. The apparatus of claim 7 wherein a width of each of said bands increases towards a longitudinal mid-portion thereof.

12. The apparatus of claim 8 including a spyder held adjacent said another end of said diaphragm, wherein said hub seats on said spyder, and purge means for manually moving said post to open said inlet means.

13. The apparatus of claim 6 wherein said means for opening said inlet means comprise:

a plurality of pivot levers arranged in said diaphragm;

means for causing said levers to pivot in response to said diaphragm distortion; and means for operating said inlet valve means in response to pivoting of said levers.

14. The apparatus of claim 13 wherein said levers have first and second substantially transverse sides joined at a bend, said first sides extending substantially parallel to one another and to the axis of said diaphragm to form an annular array, and being positioned closely adjacent the interior surface of said diaphragm, said second sides extending radially toward the diaphragm axis.

15. The apparatus of claim 14 wherein said means for causing said levers to pivot comprise a fixed disc shaped member positioned in said array and adjacent said second sides of said levers, wherein a periphery of said disc shaped member extends to said bends of said levers, whereby said levers pivot about said periphery of said disc shaped member as a fulcrum.

16. The apparatus of claim 15 wherein said inlet valve means include a valve member and wherein said means for operating said inlet valve means comprise:

a rod extending coaxially with said diaphragm, said rod having said valve member at one end thereof and having another end extending through said disc shaped member and through a plane defined by said second sides of said levers; and enlargement means fixed to said another end of said rod;

wherein said spring means comprise means for biasing said rod to a position such that said valve member seals said opening of said inlet means and said second sides of said levers are pressed between said disc shaped member and said enlargement means, whereby said pivoting of said levers moves said rod along the axis thereof to open said inlet valve means.

17. The apparatus of claim 16 including a tube in said casing and extending coaxially with said diaphragm, said tube having one end fixed to said casing around said opening of said inlet means and another end fixed to said disc shaped member, said one end of said tube having apertures therein, and said rod extending through said tube, wherein said spring means comprise a coil spring wound around said rod in said tube and having an end pressed against said disc shaped member and another end pressed against said valve member.

18. The apparatus of claim 16 wherein said enlargement means includes a nut threaded onto said rod, whereby an axial position of said rod may be adjusted.

19. The apparatus of claim 13 wherein said means for communicating said pressure differential to said diaphragm comprises at least one opening in the cylindrical surface of said casing.

20. The apparatus of claim 13 including purge means comprising:

a purge button assembly at an end of said casing opposite said inlet means, said purge button assembly including means for maintaining fluid tightness for said opposite end only in a direction for exhausting air from said casing;

means for mounting said purge button assembly for movement substantially in a direction coaxial with said casing; and means for pivoting said pivot levers in response to movement of said purge button assembly towards said inlet means.

21. The apparatus of claim 20 wherein said means for mounting said purge button assembly comprises a purge button support diaphragm connected between said casing and said purge button assembly in a fluid tight manner, whereby said movement of said purge button assembly is responsive to an inhalation of the user so that said means for operating also comprise said purge means.

22. The apparatus of claim 20, wherein said means for maintaining fluid tightness for said opposite end only in an exhausting direction comprises an exhaust valve mounted on said purge button assembly.

23. The apparatus of claim 20, wherein said means for pivoting said levers in response to movement of said purge button assembly comprise:

a leg of each of said levers extending towards said purge button assembly;

a tapered ring comprising a portion of said purge button assembly and extending to a position adjacent said legs of said levers; and bevel means on said legs for pivoting said levers in response to said tapered ring engaging and pressing said bevel means.

* * * * *